United States Patent [19]

Lankheet

[11] 4,205,499

[45] Jun. 3, 1980

[54] POOL WALL AND DECK ASSEMBLY AND METHOD OF ASSEMBLING THE SAME

[76] Inventor: Jay A. Lankheet, 1329 Bayview Ave., Holland, Mich. 49423

[21] Appl. No.: 977

[22] Filed: Jan. 4, 1979

[51] Int. Cl.[2] ..... E04H 3/16

[52] U.S. Cl. ..... 52/169.7; 4/506

[58] Field of Search ..... 52/169.7, 169.8, 745; 4/172.19

[56] References Cited

U.S. PATENT DOCUMENTS

| | | | |
|---|---|---|---|
| 3,416,165 | 12/1968 | Pereira | 52/169.8 X |
| 3,654,639 | 4/1972 | Lankheet | 4/172.19 |
| 3,789,435 | 2/1974 | Heisner | 4/172.19 |
| 4,044,514 | 8/1977 | Rubin et al. | 52/169.7 |
| 4,120,126 | 10/1978 | West | 52/169.7 |

FOREIGN PATENT DOCUMENTS

| | | | |
|---|---|---|---|
| 1305765 | 2/1973 | United Kingdom | 4/172.19 |

*Primary Examiner*—J. Karl Bell

*Attorney, Agent, or Firm*—Price, Heneveld, Huizenga & Cooper

[57] ABSTRACT

The specification discloses a pool wall and deck assembly in which a plurality of deck support beams are secured in brackets located towards the top of molded plastic pool wall sections. Brace beams are joined to the deck support beams at a point spaced from the wall section and extend downwardly therefrom back towards the wall sections. One end of each brace beam abuts the bottom flange and the exterior surface of the wall sections and is pinned to the bottom flange thereof and to the earth there beneath.

20 Claims, 2 Drawing Figures

POOL WALL AND DECK ASSEMBLY AND METHOD OF ASSEMBLING THE SAME

BACKGROUND OF THE INVENTION

The present invention relates generally to swimming pools, and in particular, to an improved type of portable swimming pool.

In the construction of swimming pools for private homes, it has been customary to either construct an elaborate concrete pool or other type of construction of a permanent nature, or to construct a portable above ground pool. Sometimes a separate deck is constructed around the above ground pool. In the case of permanent pool constructions, installation costs have always been high. Another problem with this permanent type of pool construction is that the concrete pool cannot be moved when the owner moves.

These problems led to the development of a class of portable pools characterized by the fact that a substantial portion of the pool structure is above ground and some below ground in an excavation. Generally, these types of pools are provided with rigid sidewall structures extending above ground, sometimes surrounded by a deck disposed about the periphery of the upstanding wall structure. In many cases, the upstanding wall structure is constructed about an excavation which is then lined with a typically flexible plastic liner to increase the depth of the pool.

However, properly anchoring the plastic wall in the excavation is difficult. Special footings or embedded posts may be necessary. This then becomes even more of a problem when an adjacent deck has to be properly anchored in the ground.

One attempt to resolve this involves essentially eliminating a pool wall and hanging a liner from the top of a deck which is anchored in the ground. Even here, the deck has to be properly and carefully anchored as by posts driven into the earth.

SUMMARY OF THE INVENTION

These and other problems in the prior art are solved by provision of a plastic pool wall and deck assembly wherein by using a unique assembly of the two, one satisfactorily anchors both. A deck support beam is secured to and extends from a support bracket disposed on a molded plastic pool wall section near the top thereof. A generally horizontally oriented bottom flange extends from the exterior face adjacent the bottom of the wall section. One end of at least one angularly extending brace beam abuts the bottom flange and the exterior face of each wall section, and is secured to the bottom flange and the underlying earth. The opposite ends of the angled brace beam and the transverse deck support beam are secured together.

Preferably the assembly is disposed in a pool excavation having an angular outside wall supporting a substantial length of the angularly extending brace beams. The swimming pool wall and deck assembly of the present invention provides an integrated, structurally interdependent deck and wall structure which is much simpler and easier to install than prior art portable pool structures. Furthermore, the transverse deck support beams support a generally planar deck extending about the periphery of the pool at approximately ground level, eliminating aesthetically displeasing above-ground temporary pool wall and deck structures.

DESCRIPTION OF THE PREFERRED EMBODIMENTS

Figures 1, 2:
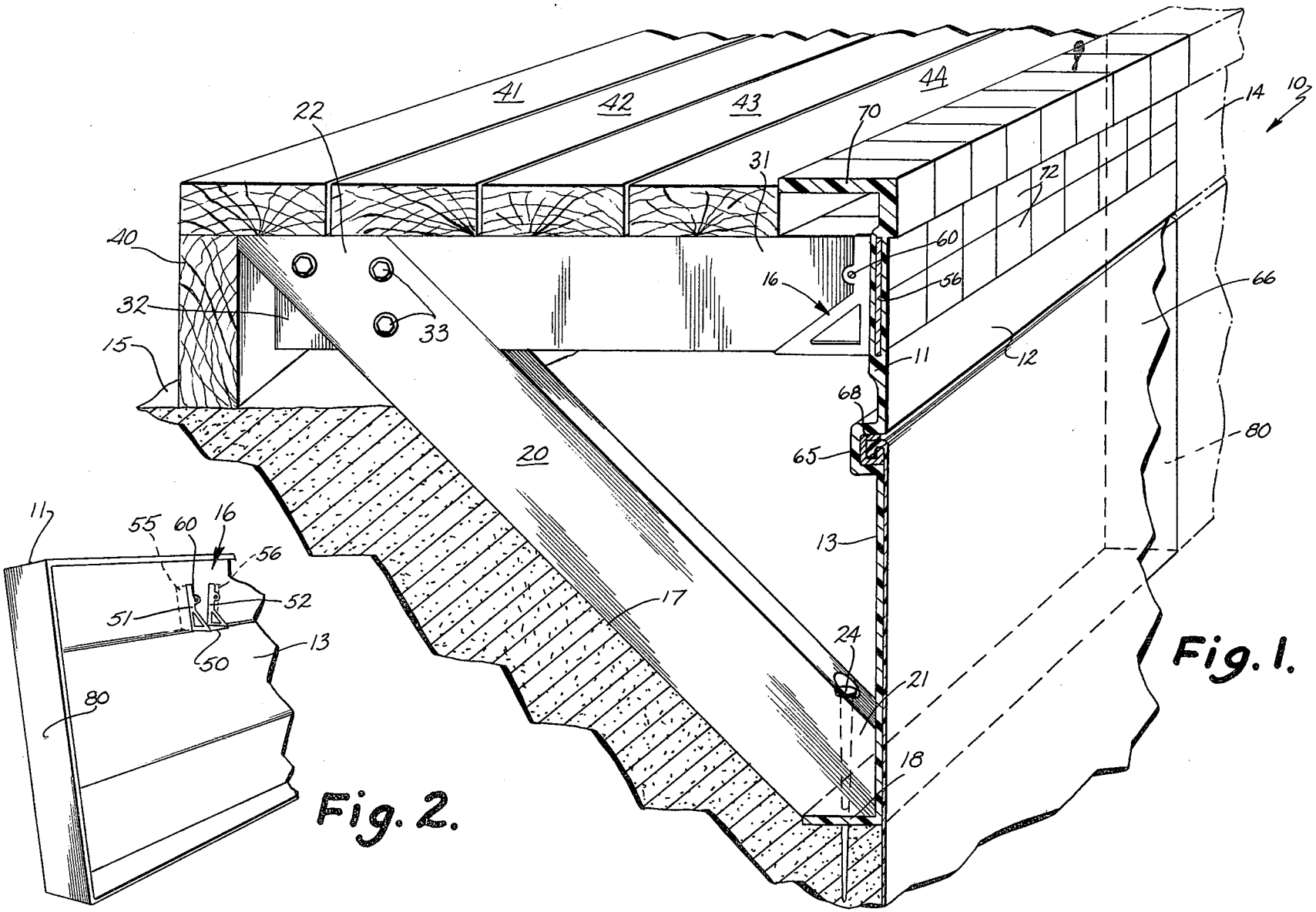
FIG. 1 is a fragmentary, partially in section, perspective view of one section of the pool and deck wall assembly of the present invention.
FIG. 2 is a fragmentary, perspective view of a wall section of the pool, deck and wall section assembly of the present invention.

Referring specifically to FIG. 1, a pool wall and deck section assembly 10 constructed according to the present invention comprise a molded plastic wall section 11 defining generally planar, vertically oriented, interior and exterior faces 12 and 13, respectively. Preferably, the wall section 11 is disposed in a pool excavation such that a substantial portion of the wall section 11 extends below the ground level defined by surface 15. A plurality of such wall sections are aligned in abutting side-by-side relationship as indicated by the wall section illustrated in phantom at 14 abutting the wall section 11.

The wall section 11 includes at least one, and preferably a plurality of beam support brackets 16 disposed at or near the top of the exterior face of the wall section 11. The support brackets 16 are disposed in a linear array, each support bracket 16 having approximately the same vertical elevation. The wall section 11 further includes a generally horizontally oriented bottom flange 18 extending from the bottom of the exterior face 13 of wall section 11. At least one and preferably a plurality of angularly extending brace beams 20, having first and second ends 21 and 22, respectively, are pinned to the bottom flange 18. More specifically, the first ends 21 of brace beams 20 abut both the exterior surface 13 of wall section 11 and bottom flange 18 and pin 24 extends through first end 21 of brace beam 20 and the bottom flange 18 into the substrate thereunder.

At least one, and preferably a plurality, of transverse deck support beams 30 including first and second ends 31 and 32, respectively, extend horizontally and orthogonally to the wall section 11. The first ends 31 of the transverse deck support beams 30 are mounted in beam support brackets 16. The second ends 22 and 32 of the brace beams 20 and transverse deck support beams 30, respectively, are secured together by suitable means such as an array of bolts 33 extending therethrough.

Preferably, the wall and deck section assembly 10 includes a generally horizontally extending longitudinal deck support beam 40. The longitudinal deck support beam 40 is secured to the second ends 32 of transverse deck support beams 30 and extends parallel to the wall section 11. The longitudinal deck support beam 40 may be secured to the second ends 32 of transverse deck support beams 30 by nails, lag bolts or other suitable means. An array of parallel, horizontal and longitudinally extending deck beams 41, 42, 43 and 44 are supported by transverse and longitudinal deck support beams 30 and 40, respectively, and secured thereto by nails or the like. Preferably, the planar surface defined by the deck beams 41 through 44 is directly adjacent ground level (allowing for the thickness of beam 40) defined by the surface 15. Preferably, the pool wall and deck section assembly of the present invention is supported by a substrate 15 of packed, undisturbed earth which extends under a substantial portion of the length of longitudinal deck support beam 40 and angled brace beams 20.

Referring now also to FIG. 2, further details of the beam support brackets 16 are illustrated. Preferably, the beam support brackets 16 comprise a folded, sheet metal beam cradle molded into plastic wall section 11. More specifically, the folded sheet metal beam cradle comprises a generally horizontal floor portion 50 and first and second upstanding sidewall portions 51 and 52, respectively, the sidewall portions depending from opposite sides of the horizontal floor portion 50. The horizontal floor portion 50 and the first and second upstanding sidewall portions 51 and 52 are generally orthogonal to each other and to the exterior surface 13 of the wall section 11. However, as best illustrated in FIG. 2, the first and second upstanding sidewall portions 51 and 52 may be canted apart slightly to facilitate insertion of transverse deck support beams 30. The first and second upstanding sidewall portions 51 and 52 include first and second flanges 55 and 56, respectively, depending therefrom. The first and second flanges 55 and 56 are embedded in the plastic wall section 11, which is preferably of a laminated fiberglass construction. The flanges 55 and 56 are embedded in the laminate during the construction of the wall section 11 such that the flanges are surrounded by laminations, as best illustrated by the cross section of flange 56, illustrated in FIG. 1. Also, at least one of the first and second flanges 51 and 52 include one or more apertures 60 through which a fastener, such as a nail, may be inserted for securely mounting the first end 31 of transverse deck support beams 30 thereto.

Referring now specifically to FIG. 1, it is illustrated that the wall section 11 is provided with a longitudinally extending groove 65 with an extruded channel **65*a* embedded therein. The longitudinal groove 65 extends the length of each pool wall section 11 at approximately the same vertical elevation. A high hung pool liner 66 includes a bead 68 at its top edge which is secured in the longitudinally extending groove 65. The shape of edge 68 and groove 65 (including channel 65*a*) are such that the liner may be hung from the groove 65 by inserting bead 68 of liner 66 into groove 65**. The details of this construction do not form a part of this invention, but a preferred arrangement can be seen in my co-pending application Ser. No. 958,449 filed on Nov. 7, 1978 and entitled VINYL LINER AND SEALING GROOVE ASSEMBLY FOR POOLS.

The wall section 11 also includes a generally horizontally extending top flange 70. The top flange 70 provides a top surface for wall section 11 that defines the edge of the swimming pool and cooperates with the planar deck surface defined by deck beams 41 through 44. The top flange 70 and the top portion of wall section 11 may be provided with decorative tile as indicated by the numeral 72. The tile 72 may be molded in situ with the wall section 11 or may be secured thereto. The wall section 11 further includes vertically oriented side flanges such as the one illustrated at 80, the flanges extending in a direction orthogonal to the exterior surface 13 of wall section 11. The side flanges 80 strengthen the wall section 11 and facilitate installation of a plurality of such wall sections in abutting, side-by-side relationship without overlapping of the wall sections.

METHOD OF ASSEMBLY

According to the method of the present invention, a pool wall and deck is assembled by excavating a hole in the earth for defining a swimming pool. The outside wall of the hole or excavation is provided with a predetermined angular slope 17. The excavation may completely define the pool or initially may comprise a simple trench defining the outside edge of the pool. A plurality of molded plastic wall sections are provided, defining vertically oriented interior and exterior faces 12 and 13, respectively. The wall sections include a plurality of beam support brackets 16 disposed on the exterior surface 13 of the wall section at approximately the same vertical elevation adjacent the top of the interior surface of each wall section. The wall sections further include a bottom flange 18 depending adjacent the bottom of the exterior surface 13 of each wall section. A linear array of the wall sections is then formed by sequentially aligning the same in abutting side-by-side relationship, such as the wall sections 11 and 14 in FIG. 1, to define a pool wall. A plurality of brace beams 20 and transverse deck support beams 30 are provided. The brace beams are provided with first and second ends 21 and 22, respectively and the transverse deck support beams are provided with first and second ends 31 and 32, respectively. The first ends 21 of the brace beams 20 are then pinned to the bottom flange 18 and the substrate thereunder with pins 24 extending therethrough. The first ends 21 of brace beams 20 preferably abut both the exterior surface 13 and the bottom flange 18 of the wall section 11. A plurality of transverse deck support beams 30 are then mounted in support brackets 16 by fastening the first ends 31 of each transverse deck support beam 30 thereto. The brace beams 20 and transverse deck support beams 30 extend in a direction orthogonal to the wall section 11 and the second ends 22 and 32 of the brace beams 20 and transverse deck support beams 30 are then secured together by a plurality of bolts 33 or the like. The surface 17 of the original excavation provides a substrate of packed, undisturbed earth for supporting a substantial length of the brace beam 20.

In subsequent steps of the method, a longitudinal deck support beam 40 is secured to the second ends 32 of transverse deck support beams 30 with nails, lag bolts or the like. A planar deck surface is then formed by securing a parallel array of longitudinally extending deck beams 41 through 44 to the transverse deck support beam 30 and the longitudinal deck support beam 40.

If, in the aforementioned excavating step, the complete pool is initially excavated, sand is then distributed on the bottom of the pool and the high hung pool liner 66 is inserted in groove 65 of the wall sections. If, in the aforementioned excavating step, a complete excavation is not initially made, once the deck and pool wall structure of the present invention is assembled, further excavation will deepen the bottom of the pool to the desired level at which time sand will be distributed and the high hung pool liner will be installed.

The integral pool wall and structure of the present invention is simple and relatively easy to install. The materials used are relatively inexpensive and, for example, the brace beams 20 may comprise two inch by four inch wooden beams pinned to fiberglass wall section 11 and bolted to a two inch by four inch transverse deck support beam 30. The longitudinal deck support beam 40 may be formed from a two inch by six inch wooden beam and, in the example illustrated in FIG. 1, the deck beams 41 through 44 may be formed from two inch by six inch beams to provide a wooden deck length of aproximately twenty-four inches. The wooden deck defined by beams 41 through 44 only extends approximately eight inches above ground level as defined by surface 15. Once the deck and wall assembly are in place, the space behind wall 11, which is shown open in the drawings, is back filled by pouring sand or the like through the cracks between deck beams 41 through 44. This prevents water from collecting behind wall 11 and draining down underneath lines 66.

Thus, in addition to providing a relatively inexpensive temporary pool construction, the pool wall and deck assembly of the present invention eliminates aesthetically displeasing above ground pool wall and deck structures. The pool wall and deck structure when used in conjunction with an appropriately size high hung pool liner may be used to form a pool of any desired size or depth. Corners between pool sidewalls may be formed by placing wall sections constructed according to the present invention, in side-by-side relationship at the desired angular orientation with the longitudinal deck support beams and the deck beams appropriately mitered, or specially manufactured corner pieces may be provided.

The above description should be considered as exemplary and that of the preferred embodiment only. The true scope and spirit of the present invention should be determined with reference to the appended claims. It is desired to include within the appended claims all such modifications of the invention that come within the proper scope of the invention.

The embodiments of the invention in which an exclusive property or privilege is claimed are defined as follows:

1. A pool wall and deck section assembly comprising:

a molded plastic wall section defining generally planar vertically oriented interior and exterior faces;

at least one generally horizontally extending transverse deck support beam having first and second ends, said first end of said transverse deck support beam being secured to said exterior face near the top of said exterior face;

a generally horizontally oriented bottom flange extending from said exterior face of said wall section adjacent the bottom of said exterior face;

at least one angularly extending brace beam having first and second ends, said first end of said brace beam operably abutting said bottom flange and said exterior face of said wall section and said second end of said brace beam being secured to said second end of said transverse deck support beam; and securing means extending through said first end of said brace beam and said bottom flange for securing said first end of said brace beam and said bottom flange to a substrate disposed therebelow.

2. The pool wall and deck section assembly of claim 1 further including at least one beam support bracket extending from said exterior face of said wall section, said beam support bracket receiving said first end of said transverse deck support beam.

3. The pool wall and deck section assembly of claim 1 further including a generally horizontally extending longitudinal deck support beam, said longitudinal deck support beam being secured to said second end of said transverse deck support beam, said longitudinal deck support beam being disposed generally parallel to said wall section and orthogonal to said transverse deck support beam.

4. The pool wall and deck section assembly of claim 3 wherein said longitudinal support beam rests on a substrate of undisturbed earth.

5. The pool wall and deck section assembly of claim 1 wherein a substantial length of said brace beam rests on a substrate of undisturbed earth.

6. The pool wall and deck section assembly of claim 1 further including a parallel, horizontal and longitudinally extending array of deck beams secured to said transverse deck support beam, said array of deck beams being disposed parallel to said wall section.

7. The pool wall and deck section assembly of claim 2 wherein said beam support bracket comprises a folded sheet metal beam cradle.

8. The pool wall and deck section assembly of claim 7 wherein said folded sheet metal beam cradle includes at least one flange depending therefrom said flange being embedded in said plastic wall section.

9. The pool wall and deck section assembly of claim 7 wherein said folded sheet metal beam cradle comprises:

a generally horizontal floor portion; and first and second upstanding sidewall portions depending from opposite sides of said horizontal floor portion;

said horizontal floor portion and said first and second upstanding sidewall portions being generally orthogonal to each other and to said exterior surface of said wall section.

10. The pool wall and deck section assembly of claim 9 wherein at least one of said first and second upstanding sidewall portions includes at least one preformed apertures for receiving a fastener for securing said transverse deck support beam thereto.

11. The pool wall and deck section assembly of claim 9 wherein said first and second upstanding sidewall portions include first and second flanges, respectively, depending therefrom, said first and second flanges being embedded in said plastic wall section.

12. The pool wall and deck section assembly of claim 1 wherein said interior face of said wall section includes a longitudinally extending groove for receiving a plastic pool liner.

13. The pool wall and deck section assembly of claim 1 wherein said plastic wall section is formed of fiberglass.

14. The pool wall and deck section assembly of claim 1 wherein said wall section includes a generally horizontally oriented top flange, extending from the top of said wall section, said top flange extending to and cooperating with a planar array of deck beams supported by said transverse deck support beam.

15. The pool wall and deck section assembly of claim 1 wherein said wall section includes first and second generally vertically oriented side flanges for strengthening said wall section and facilitating installation of a plurality of said wall sections in abutting side-by-side relationship.

16. A method of assembling a pool wall and deck comprising the steps of:

excavating a hole in the earth defining a swimming pool, the outside wall of the hole having a predetermined angular slope;

providing a plurality of molded plastic wall sections defining planar vertically oriented interior and exterior faces, said wall sections including a plurality of beam support brackets disposed on the exterior face of said wall sections, at approximately the same elevation adjacent the top of said wall sections, and each of said wall sections, including a flange depending from adjacent the bottom of said wall sections;

forming a linear array of said wall sections by sequentially aligning the same in abutting side-by-side relationship to define a pool wall inside of the outside wall of said hole;

providing a plurality of transverse deck support beams and a plurality of brace beams, said transverse deck support beams and said brace beams having first and second ends;

securing a plurality of brace beams to said wall sections and to the earth with securing means extending through said first ends of said brace beams, said flange and the earth therebelow, a substantial portion of the length of each of said brace beams being supported by said outside wall of said hole;

mounting a plurality of transverse deck support beams to said beam support brackets by fastening said first ends of said transverse deck support beams thereto, said brace beams and said transverse deck support beams extending in a direction orthogonal to said wall sections; and securing said second ends of said brace beams and said transverse deck support beams theretogether.

17. The method of claim 16 further including the step of providing a longitudinal deck support beam disposed parallel to said wall sections, said longitudinal deck support beam being secured to said second ends of said transverse deck support beams and supported over a substantial portion of its length by the earth.

18. The method of claim 16 further including the steps of securing a parallel array of longitudinal deck beams to said transverse deck support beams.

19. The method of claim 16 further including the step of lining said pool with a high hung plastic liner secured in a groove disposed on the interior face of said wall sections.

20. The method of claim 17 wherein only the outline of said pool is defined in said excavating step, said pool being deepened by a subsequent excavating step after the walls of said pool are assembled.

* * * * *